US008482495B2

(12) United States Patent
Kim et al.

(10) Patent No.: US 8,482,495 B2
(45) Date of Patent: Jul. 9, 2013

(54) PIXEL AND ORGANIC LIGHT EMITTING DISPLAY HAVING A COMPENSATION UNIT

(75) Inventors: Dong-Hwi Kim, Suwon-si (KR); Yang-Wan Kim, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 811 days.

(21) Appl. No.: 12/327,675

(22) Filed: Dec. 3, 2008

(65) Prior Publication Data

US 2009/0146987 A1 Jun. 11, 2009

(30) Foreign Application Priority Data

Dec. 6, 2007 (KR) ..... 10-2007-0126213

(51) Int. Cl.
*G09G 3/30* (2006.01)

(52) U.S. Cl.
USPC ..... 345/78; 345/82

(58) Field of Classification Search
USPC ..... 345/78, 76, 82
See application file for complete search history.

(56) References Cited

U.S. PATENT DOCUMENTS

| | | | | |
|---|---|---|---|---|
| 2005/0179625 | A1* | 8/2005 | Choi et al. | 345/76 |
| 2006/0038754 | A1* | 2/2006 | Kim | 345/76 |
| 2006/0253755 | A1* | 11/2006 | Wu | 714/726 |
| 2007/0103406 | A1* | 5/2007 | Kim | 345/76 |
| 2007/0273619 | A1* | 11/2007 | Kitazawa et al. | 345/76 |
| 2008/0111804 | A1* | 5/2008 | Choi et al. | 345/205 |

FOREIGN PATENT DOCUMENTS

| | | |
|---|---|---|
| JP | 2003-029707 | 1/2003 |
| JP | 2004-280059 | 10/2004 |
| JP | 2004-341241 | 12/2004 |
| JP | 2005-43888 | 2/2005 |
| JP | 2006-349504 | 12/2006 |
| JP | 2006-350376 | 12/2006 |
| KR | 10-2003-0081919 | 10/2003 |
| KR | 10-2004-0005163 | 1/2004 |
| KR | 10-2006-0028021 | 3/2006 |
| KR | 10-2006-0078584 | 7/2006 |
| KR | 10-2006-0113194 | 11/2006 |

OTHER PUBLICATIONS

Patent Abstracts of Japan, Publication No. 2004-280059, Published on Oct. 7, 2004, in the name of Ono, et al.

(Continued)

*Primary Examiner* — Chanh Nguyen
*Assistant Examiner* — Long D Pham
(74) *Attorney, Agent, or Firm* — Christie, Parker & Hale, LLP

(57) ABSTRACT

A pixel at an ith pixel row (i is a natural number) includes an organic light emitting diode (OLED); a driving transistor for supplying a current to the OLED and a storage capacitor between a gate electrode of the driving transistor and an (i−1)th emission control line; and a compensating unit for controlling a voltage of the gate electrode of the driving transistor to compensate for deterioration of the OLED. The compensating unit includes: a first compensating unit transistor and a second compensating unit transistor between the OLED and a first power source; first and second feedback capacitors between a second node between the first and second compensating unit transistors and a first node between the gate electrode of the driving transistor and the storage capacitor; and a third compensating unit transistor coupled between a third node between the first and second feedback capacitors and a reference voltage source.

18 Claims, 4 Drawing Sheets

OTHER PUBLICATIONS

Patent Abstracts of Japan, Publication No. 2004-341241, Published on Dec. 2, 2004, in the name of Nakai.

Patent Abstracts of Japan, Publication No. 2005-043888, Published on Feb. 17, 2005, in the name of Devos, et al.

Patent Abstracts of Japan, Publication No. 2006-349504, Published on Dec. 28, 2006, in the name of Kobayashi.

Patent Abstracts of Japan, Publication No. 2006-350376, Published on Dec. 28, 2006, in the name of Yamazaki, et al.

Korean Patent Abstracts, Publication No. 1020040005163 A, Published on Jan. 16, 2004, in the name of Kim, et al.

Korean Patent Abstracts, Publication No. 1020060078584 A, Published on Jul. 5, 2006, in the name of Lee.

Korean Patent Abstracts, Publication No. 1020060113194 A, Published on Nov. 2, 2006, in the name of Ahn, et al.

KIPO Office action dated Jul. 21, 2009, for priority Korean application 10-2007-0126213, noting listed references in this IDS, as well as KR 10-2004-0005163 previously filed in an IDS dated Dec. 3, 2008.

* cited by examiner

PIXEL AND ORGANIC LIGHT EMITTING DISPLAY HAVING A COMPENSATION UNIT

CROSS-REFERENCE TO RELATED APPLICATION

This application claims priority to and the benefit of Korean Patent Application No. 10-2007-0126213, filed on Dec. 6, 2007, in the Korean Intellectual Property Office, the entire content of which is incorporated herein by reference.

BACKGROUND

1. Field of the Invention

The present invention relates to a pixel and an organic light emitting display including the pixel.

2. Discussion of the Related Art

Recently, various flat panel displays (FPDs) having reduced weight and volume in comparison to cathode ray tubes (CRTs) have been developed. The FPDs include liquid crystal displays (LCDs), field emission displays (FEDs), plasma display panels (PDPs), and organic light emitting displays.

Among the FPDs, the organic light emitting displays display images using organic light emitting diodes (OLEDs) that generate light by re-combination of electrons and holes. The organic light emitting display has high response speed and is driven with low power consumption.

FIG. 1 is a circuit diagram illustrating a pixel of a conventional organic light emitting display.

Referring to FIG. 1, a pixel 4 of the organic light emitting display includes an organic light emitting diode OLED and a pixel circuit 2 coupled to a data line Dm and a scan line Sn to control the OLED.

The anode electrode of the OLED is coupled to the pixel circuit 2 and the cathode electrode of the OLED is coupled to a second power source ELVSS. The OLED generates light (e.g., light with predetermined brightness) to correspond to current supplied from the pixel circuit 2.

The pixel circuit 2 controls the amount of current supplied to the OLED to correspond to a data signal supplied to the data line Dm when a scan signal is supplied to the scan line Sn. Therefore, the pixel circuit 2 includes a second transistor M2' coupled between a first power source ELVDD and the OLED, a first transistor M1' coupled to the second transistor M2', the data line Dm, and the scan line Sn, and a storage capacitor Cst' coupled between the gate electrode and the first electrode of the second transistor M2'.

The gate electrode of the first transistor M1' is coupled to the scan line Sn and the first electrode is coupled to the data line Dm. Then, the second electrode of the first transistor M1' is coupled to one terminal of the storage capacitor Cst'. Here, the first electrode is one of a source electrode or a drain electrode and the second electrode is the other one of the source electrode or the drain electrode. For example, when the first electrode is the source electrode, the second electrode is the drain electrode. The first transistor M1' coupled to the scan line Sn and the data line Dm is turned on when a scan signal is supplied from the scan line Sn to supply a data signal supplied from the data line Dm to the storage capacitor Cst'. At this time, the storage capacitor Cst' is charged with a voltage corresponding to the data signal.

The gate electrode of the second transistor M2' is coupled to one terminal of the storage capacitor Cst' and the first electrode is coupled to the other terminal of the storage capacitor Cst' and the first power source ELVDD. The second electrode of the second transistor M2' is coupled to the anode electrode of the OLED. The second transistor M2' controls the amount of current supplied from the first power source ELVDD to the second power source ELVSS via the OLED to correspond to a voltage value stored in the storage capacitor Cst'. The OLED generates light corresponding to the amount of current supplied from the second transistor M2'.

However, according to the conventional organic light emitting display, an image with desired brightness may not be displayed due to a change in efficiency in accordance with the deterioration of the OLED. That is, the OLED deteriorates with the lapse of time so that an image with desired brightness may not be displayed. In practice, as the OLED deteriorates, light with lower brightness is generated.

SUMMARY OF THE INVENTION

Accordingly, it is an aspect of the present invention to provide a pixel capable of compensating a degradation of an organic light emitting diode and an organic light emitting display using the pixel In order to achieve the foregoing and/or other aspects of the present invention, according to a first aspect of an exemplary embodiment of the present invention, there is provided a pixel positioned at an ith pixel row, the pixel including an organic light emitting diode (OLED), a pixel circuit including a driving transistor for supplying a current to the OLED, the pixel circuit being configured to compensate for a threshold voltage variation of the driving transistor, the pixel circuit further including a storage capacitor coupled between a gate electrode of the driving transistor and an (i−1)th emission control line, and a compensating unit for controlling a voltage of the gate electrode of the driving transistor to compensate for deterioration of the OLED. The compensating unit includes a first compensating unit transistor and a second compensating unit transistor coupled between the OLED and a first power source, a first feedback capacitor and a second feedback capacitor positioned between a second node between the first compensating unit transistor and the second compensating unit transistor and a first node between the gate electrode of the driving transistor and the storage capacitor, and a third compensating unit transistor coupled between a third node between the first feedback capacitor and the second feedback capacitor and a reference voltage source.

According to a second aspect of an exemplary embodiment of the present invention, there is provided an organic light emitting display including: a scan driver for supplying scan signals to scan lines and for supplying emission control signals to emission control lines; a data driver for supplying data signals to data lines; and pixels positioned at regions defined by the scan lines and the data lines, wherein a pixel positioned at an ith pixel row among the pixels includes: an organic light emitting diode (OLED); a pixel circuit including a driving transistor for supplying a current to the OLED and for compensating for a threshold voltage variation of the driving transistor, the pixel circuit further including a storage capacitor coupled between a gate electrode of the driving transistor and an (i−1)th emission control line; and a compensating unit for controlling a voltage of the gate electrode of the driving transistor to compensate for deterioration of the OLED. The compensating unit includes: a first compensating unit transistor and a second compensating unit transistor coupled between the OLED and a first power source; a first feedback capacitor and a second feedback capacitor positioned between a second node between the first compensating unit transistor and the second compensating unit transistor and a first node between the gate electrode of the driving transistor and the storage capacitor; and a third compensating unit transistor coupled between a third node between the first feedback capacitor and the second feedback capacitor and a reference voltage source, wherein i is a natural number.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
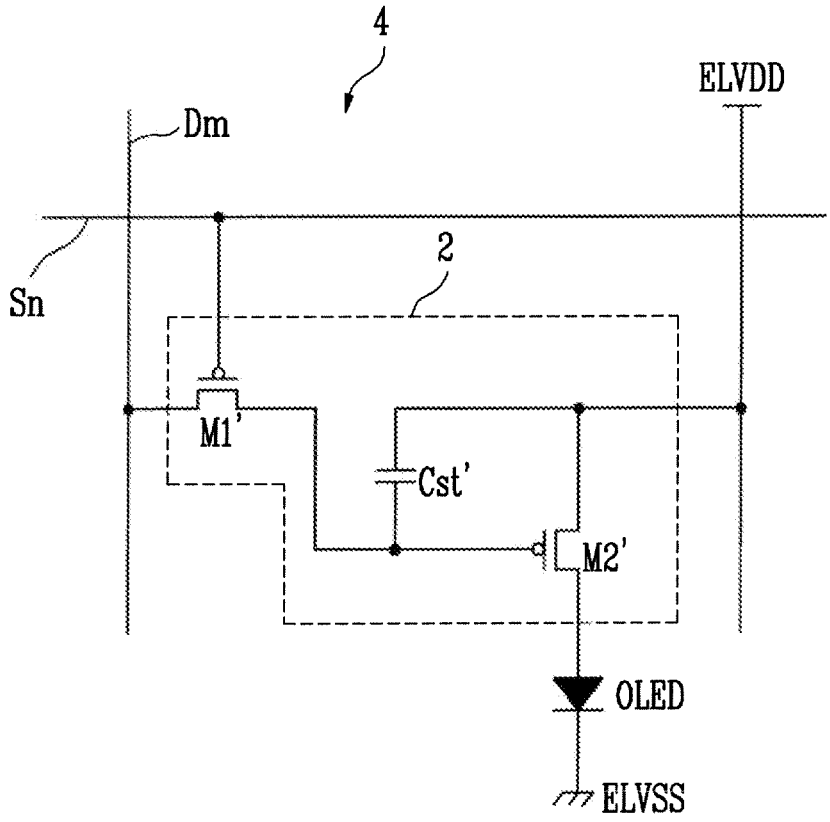
FIG. 1 (PRIOR ART)
FIG. 1 is a circuit diagram illustrating a pixel of a common organic light emitting display.

Hereinafter, certain exemplary embodiments according to the present invention will be described with reference to the accompanying drawings. Here, when a first element is described as being coupled to a second element, the first element may be directly coupled to the second element, or alternatively, may be indirectly coupled to the second element via a third element. Further, some of the elements that are not essential to the complete understanding of the invention are omitted for clarity. Also, like reference numerals refer to like elements throughout.

Figure 2:
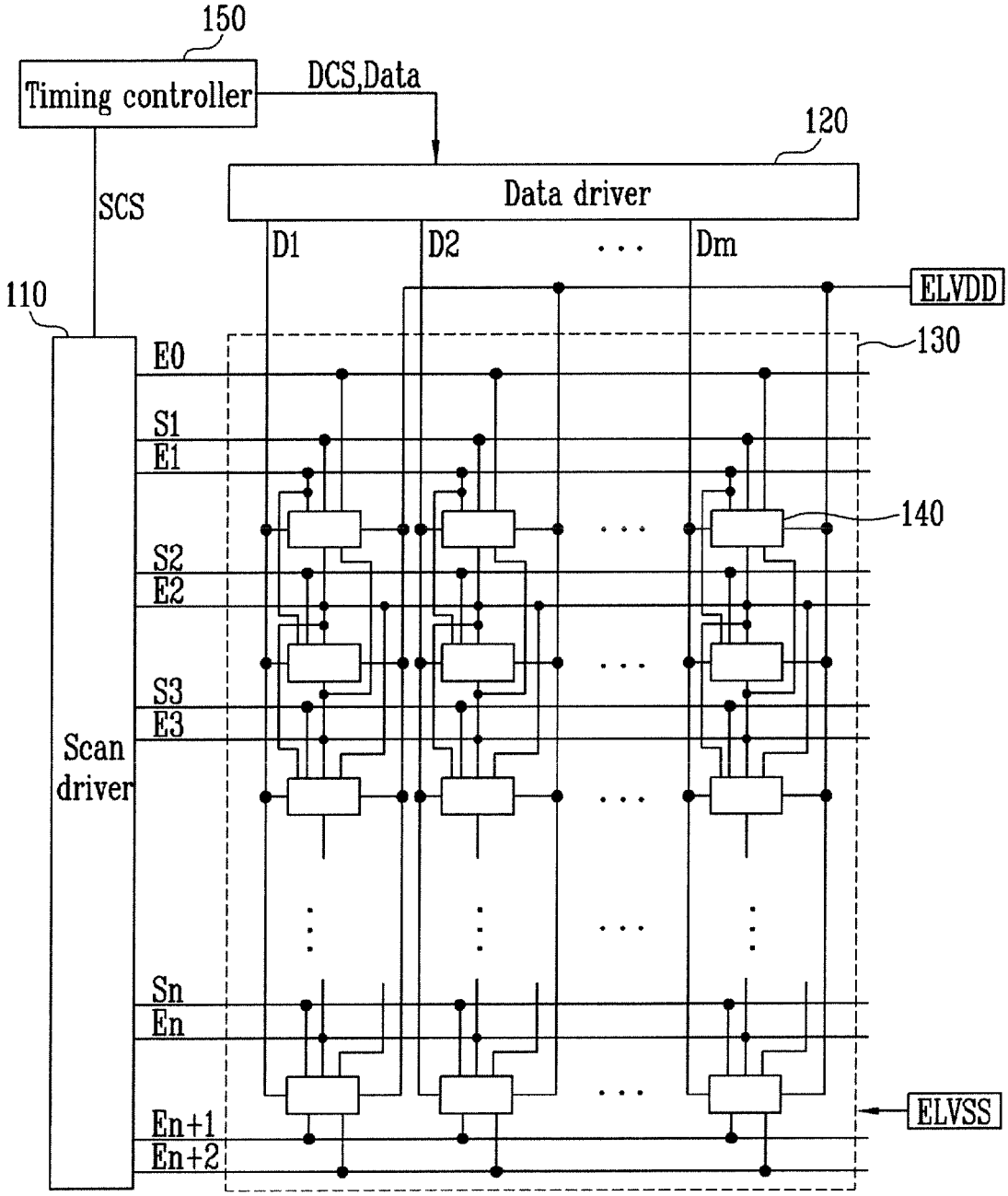
FIG. 2 illustrates an organic light emitting display according to an embodiment of the present invention.

FIG. 2 illustrates an organic light emitting display according to an embodiment of present invention.

In FIG. 2, the organic light emitting display according to an embodiment of the present invention includes a display unit 130 including pixels 140 defined by scan lines S1 to Sn, emission control lines E0 to En+2, and data lines D1 to Dm, a scan driver 110 for driving the scan lines S1 to Sn and the emission control lines E1 to En+2, a data driver 120 for driving the data lines D1 to Dm, and a timing controller 150 for controlling the scan driver 110 and the data driver 120.

The scan driver 110 receives scan driving control signals SCS from the timing controller 150. The scan driver 110 generates scan signals to sequentially supply the generated scan signals to the scan lines S1 to Sn. In addition, the scan driver 110 generates emission control signals in response to the scan driving control signals SCS to sequentially supply the generated emission control signals to the emission control lines E0 to En+2.

Here, the width of the emission control signals is larger than the width of the scan signals. For example, an emission control signal supplied to an ith (i is a natural number) emission control line Ei overlaps scan signals supplied to an (i−1) th scan line Si−1 and an ith scan line Si. Here, the emission control signals have opposite polarity to the polarity of the scan signals. For example, when the scan signals are have low polarity, the emission control signals have high polarity. By way of example, in one embodiment illustrated in FIG. 4, the scan signals applied to the scan lines have low level, and the emission control signals applied to the emission control lines have high level, however, the present invention is not limited thereto.

The data driver 120 receives the data driving control signals DCS from the timing controller 150. The data driver 120 generates data signals to supply the generated data signals to the data lines D1 to Dm in synchronization with the scan signals.

The timing controller 150 generates the data driving control signals DCS and the scan driving control signals SCS in response to synchronization signals supplied from the outside. The data driving control signals DCS generated by the timing controller 150 are supplied to the data driver 120 and the scan driving control signals SCS are supplied to the scan driver 110. The timing controller 150 also supplies data Data supplied from the outside to the data driver 120.

The display unit 130 receives a first power source ELVDD and a second power source ELVSS from the outside to supply the first power source ELVDD and the second power source ELVSS to the pixels 140. Having received the first power source ELVDD and the second power source ELVSS, the pixels 140 generate light corresponding to the data signals, respectively.

Different driving transistors typically have different threshold voltages. Therefore, there is a variation (or non-uniformity) of threshold voltages among the driving transistors in the organic light emitting display, which may result in non-uniform brightness of the pixels. The pixels 140 compensate for the deterioration of organic light emitting diodes (OLEDs) included therein and the variation (or non-uniformity) of the threshold voltage of driving transistors to generate light with desired brightness. Therefore, a compensating unit for compensating the deterioration of the OLED and a pixel circuit (including the driving transistor) for compensating for the variation of the threshold voltage of the driving transistor are provided in each of the pixels 140.

Here, in order to drive the compensating unit and the pixel circuit included in each of the pixels 140 in a desired pattern, pixels 140 positioned on an ith horizontal line are coupled to the ith scan line Si, an (i−1)th emission control line Ei−1, an ith emission control line Ei, an (i+1)th emission control line Ei+1, and an (i+2)th emission control line Ei+2.

Figure 3:
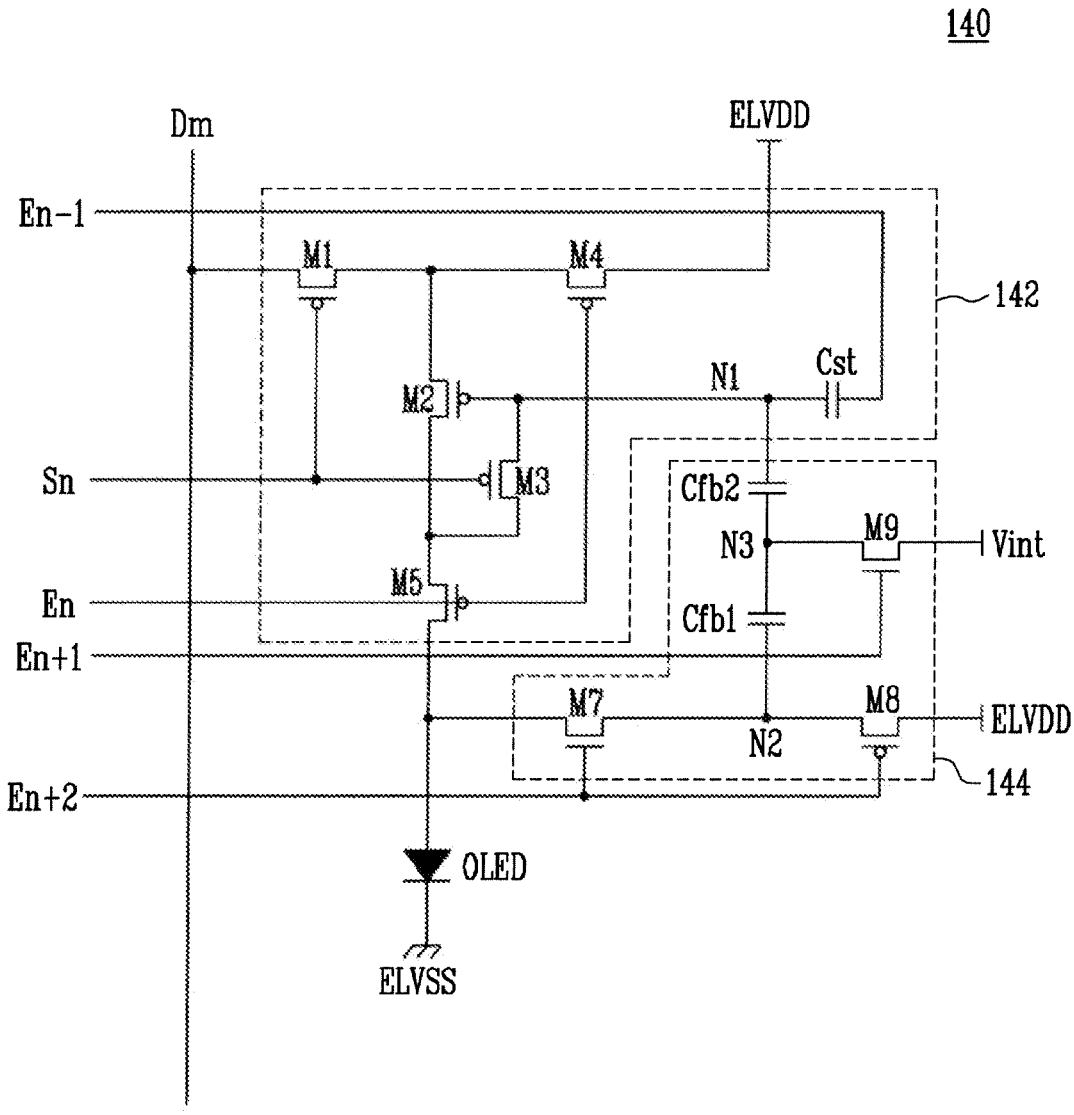
FIG. 3 illustrates a pixel according to an embodiment of the present invention, which pixel can be used in the organic light emitting display of FIG. 2.

FIG. 3 illustrates a pixel according to an exemplary embodiment of the present invention. In FIG. 3, for convenience, a pixel coupled to an nth scan line Sn and an mth data line Dm is illustrated.

Referring to FIG. 3, the pixel 140 according to a first embodiment of the present invention includes an OLED, a pixel circuit 142 including a second transistor M2 for supplying a current to the OLED and other components for compensating for a variation of the threshold voltage of the second transistor M2 (that is, a driving transistor), and a compensating unit 144 for compensating for the deterioration of the OLED.

The anode electrode of the OLED is coupled to the pixel circuit 142 and the cathode electrode of the OLED is coupled to the second power source ELVSS. The OLED generates light (e.g., light with predetermined brightness) in response to the amount of current supplied from the second transistor M2. Here, the first power source ELVDD has a higher voltage value than the voltage value of the second power source ELVSS.

The pixel circuit 142 supplies current to the OLED and compensates for the threshold voltage of the second transistor M2. Therefore, the pixel circuit 142 includes first to fifth transistors M1 to M5 and a storage capacitor Cst. The transistors M1, M3, M4 and M5 may respectively be referred to as a first switching transistor, a second switching transistor, a third switching transistor and a fourth switching transistor. The second transistor M2 may be referred to as a driving transistor.

The gate electrode of the first transistor M1 is coupled to the nth scan line Sn and the first electrode of the first transistor M1 is coupled to the data line Dm. The second electrode of the first transistor M1 is coupled to the first electrode of the second transistor M2. The first transistor M1 is turned on when a scan signal is supplied to the nth scan line Sn to supply a data signal supplied to the data line Dm to the first electrode of the second transistor M2.

The gate electrode of the second transistor M2 is coupled to a first node N1 and the first electrode of the second transistor M2 is coupled to the second electrode of the first transistor M1. The second electrode of the second transistor M2 is coupled to the first electrode of the fifth transistor M5. The second transistor M2 supplies current corresponding to a voltage applied to the first node N1 to the OLED.

The first electrode of the third transistor M3 is coupled to the second electrode of the second transistor M2 and the second electrode of the third transistor M3 is coupled to the first node N1. Then, the gate electrode of the third transistor M3 is coupled to the nth scan line Sn. The third transistor M3 is turned on when the scan signal is supplied (i.e., the scan signal has low level) to the scan line Sn to diode-couple the second transistor M2.

The first electrode of the fourth transistor M4 is coupled to the first power source ELVDD and the second electrode of the fourth transistor M4 is coupled to the first electrode of the second transistor M2. The gate electrode of the fourth transistor M4 is coupled to an nth emission control line En. The fourth transistor M4 is turned on when an emission control signal is not supplied (i.e., the emission control line is at low level) to the nth emission control line En to electrically couple the first power source ELVDD to the first electrode of the second transistor M2.

The first electrode of the fifth transistor M5 is coupled to the second electrode of the second transistor M2 and the second electrode of the fifth transistor M5 is coupled to the OLED. The gate electrode of the fifth transistor M5 is coupled to the nth emission control line En. The fifth transistor M5 is turned on when the emission control signal is not supplied (i.e., the emission control line is at low level) to the emission control line En to electrically couple the second transistor M2 to the OLED.

The storage capacitor Cst is coupled between the first node N1 and the (n−1)th emission control line En−1. The storage capacitor Cst charges a voltage (e.g., a predetermined voltage) in response to a voltage applied to the first node N1.

The compensating unit 144 controls the voltage of the gate electrode of the second transistor M2 (that is, the voltage of the first node N1) in response to the deterioration of the OLED. That is, the compensating unit 144 performs control so that the voltage of the first node N1 is reduced as the OLED deteriorates to compensate for the deterioration of the OLED. Therefore, the compensating unit 144 includes seventh to ninth transistors M7 to M9, a first feedback capacitor Cfb1, and a second feedback capacitor Cfb2. The seventh, eighth and ninth transistors M7, M8 and M9 may respectively be referred to as a first compensating unit transistor, a second compensating unit transistor and a third compensating unit transistor.

The first electrode of the seventh transistor M7 is coupled to a second node N2 and the second electrode of the seventh transistor M7 is coupled to the anode electrode of the OLED. Then, the gate electrode of the seventh transistor M7 is coupled to an (n+2)th emission control line En+2. The seventh transistor M7 is turned on when an emission control signal is supplied to the (n+2)th emission control line En+2. Therefore, the seventh transistor M7 is formed to have different conductivity from the conductivity of an eighth transistor M8, for example, is an NMOS transistor. When the seventh transistor M7 is turned on, the second node N2 and the anode electrode of the OLED are electrically coupled to each other.

The first electrode of the eighth transistor M8 is coupled to the first power source ELVDD and the second electrode of the eighth transistor M8 is coupled to the second node N2. The gate electrode of the eighth transistor M8 is coupled to the (N+2) emission control line En+2. The eighth transistor M8 is turned on when the emission control signal is not supplied (i.e., when the emission control line is at low level) to the (n+2)th emission control line En+2 to electrically couple the first power source ELVDD to the second node N2. Therefore, the eighth transistor M8 is a PMOS transistor.

The first terminal of the first feedback capacitor Cfb1 is coupled to the second node N2 and the second terminal of the first feedback capacitor Cfb1 is coupled to a third node N3. The feedback capacitor Cfb1 changes the voltage of the third node N3 in response to the amount of change in the voltage of the second node N2.

The first terminal of the second feedback capacitor Cfb2 is coupled to the third node N3 and the second terminal of the second feedback capacitor Cfb2 is coupled to the first node N1. The feedback capacitor Cfb1 changes the voltage of the first node N1 in response to the amount of change in the voltage of the third node N3.

That is, the first feedback capacitor Cfb1 and the second feedback capacitor Cfb2 are positioned between the second node N2 and the first node N1 to change the voltage of the first node N1 in response to the amount of change in the voltage of the second node N2.

The first electrode of the ninth transistor M9 is coupled to an initializing power source Vint and the second electrode of the ninth transistor M9 is coupled to the third node N3. The gate electrode of the ninth transistor M9 is coupled to the (n+1)th emission control line En+1. The ninth transistor M9 is turned on when an emission control signal is supplied to the (n+1)th emission control line En+1 to electrically couple the third node N3 to the initializing power source Vint. Therefore, the ninth transistor M9 is an NMOS transistor.

Figure 4:
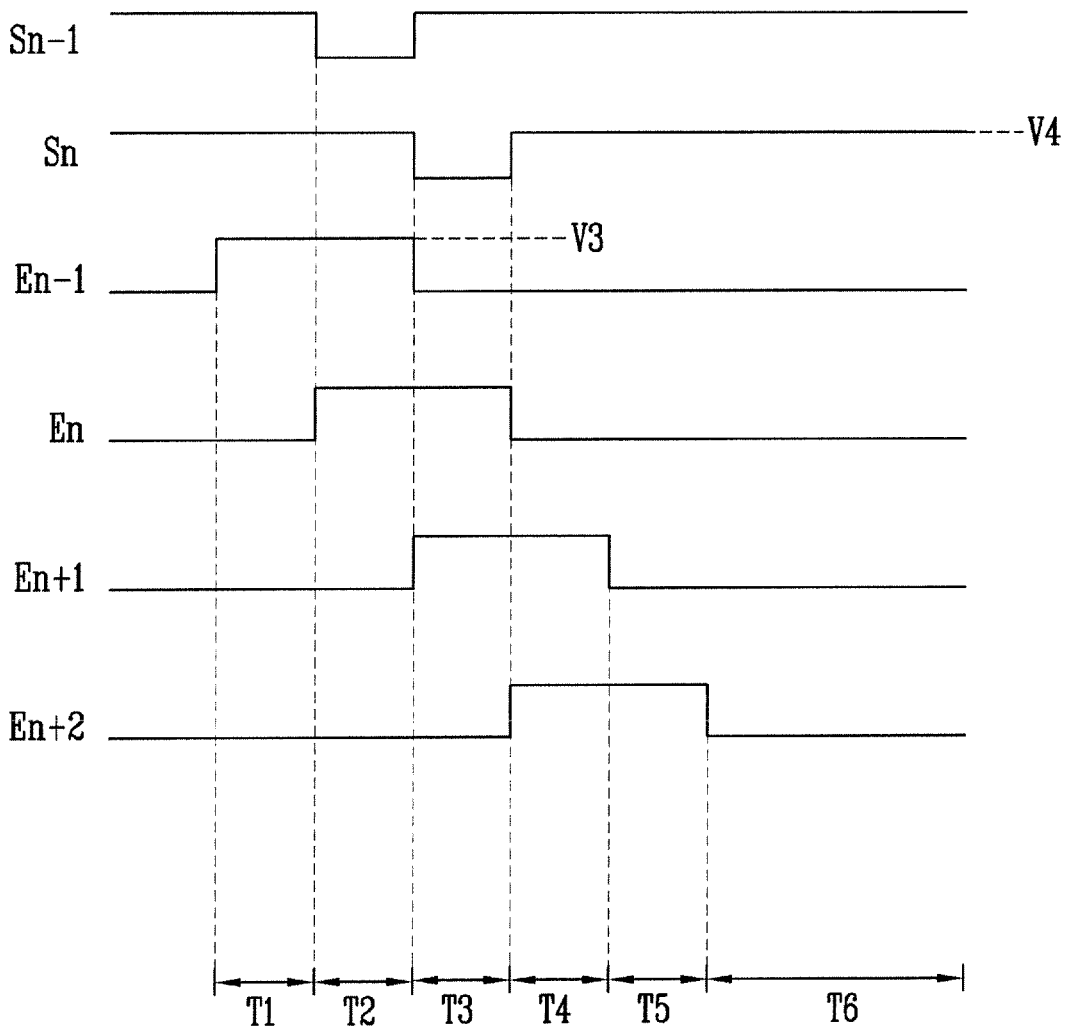
FIG. 4 illustrates waveforms corresponding to the operation processes of the pixel of FIG. 3

FIG. 4 illustrates a waveform the operation processes of the pixel of FIG. 3

The operation processes of the pixel of FIG. 3 will be described in detail with reference to FIGS. 3 and 4. First, an emission control signal is supplied (i.e., the emission control signal has high level) to an (n−1)th emission control line En−1 in a first period T1. When the emission control signal is supplied to the (n−1)th emission control line En−1, the voltage of the first node N1 is increased by the storage capacitor Cst.

That is, since the first node N1 is floated when the emission control signal is supplied to the (n−1)th emission control line En−1, the voltage of the first node N1 is increased to a voltage value obtained by adding the value of a voltage applied to the first node N1 to the voltage value of the emission control signal supplied to the emission control line En−1 in a previous period. In this case, the third transistor M3 is turned on, such that the voltage applied to the first node N1 is initialized via the third transistor M3, the fifth transistor M5, and the OLED.

In more detail, a fourth voltage V4 is supplied to the scan lines S in a period where the scan signals are not supplied and a third voltage V3 is supplied to the emission control lines E when the emission control signals are supplied. Here, the third voltage V3 is greater than or equal to the fourth voltage V4.

When it is assumed that the fourth voltage V4 is equal to the third voltage V3, when the emission control signal is supplied to the (n−1)th emission control line En−1, the voltage of the first node N1 is increased to a voltage obtained by adding the third voltage V3 to the voltage applied to the first node N1 in a previous period, that is, a voltage charged in the storage capacitor Cst. Therefore, when the emission control signal is supplied to the (n−1)th emission control line En−1, the voltage of the first node N1 is set to be higher than the fourth voltage V4 supplied to the gate electrode of the third transistor M3 so that the third transistor M3 is turned on.

According to an embodiment of the present invention, in order to secure the reliability of the operation, the third voltage V3 can be set to be higher than the fourth voltage V4. For example, the voltage of the third voltage V3 can be set to be higher than a voltage obtained by adding the fourth voltage V4 to the threshold voltage of the third transistor M3.

As described above, according to an embodiment of the present invention, the voltage of the first node N1 is initialized using the emission control signal supplied to the (n−1)th emission control line En−1 in the first period T1. Therefore, according to an embodiment of the present invention, an additional transistor for initialization may not be required.

An emission control signal is supplied to the nth emission control line En in a second period T2. When the emission control signal is supplied to the nth emission control line En, the fourth transistor M4 and the fifth transistor M5 are turned off.

The scan signal is supplied to the nth scan line Sn and the emission control signal is supplied to the (n+1)th emission control line En+1 in a third period T3. Then, the supply of the emission control signal to the (n−1)th emission control line En−1 is stopped in the third period T3. When the supply of the emission control signal to the (n−1)th emission control line En−1 is stopped, the voltage of the first node N1 is reduced.

When the scan signal is supplied to the nth scan line Sn, the first transistor M1 and the third transistor M3 are turned on. When the third transistor M3 is turned on, the second transistor M2 is diode-coupled. When the first transistor M1 is turned on, the data signal supplied to the data line Dm is supplied to the first electrode of the second transistor M2. Here, since the voltage of the first node N1 was initialized in the first period T1, the second transistor M2 is turned on. Therefore, a data signal supplied from the first transistor M1 is supplied to the first node N1 via the second transistor M2 and the third transistor M3. At this time, a data signal and a voltage corresponding to the threshold voltage of the second transistor M2 are applied to the first node N1 and the storage capacitor Cst charges a voltage (e.g., a voltage corresponding to the voltage applied to the first node N1).

When the emission control signal is supplied to the (n+1)th emission control line En+1, the ninth transistor M9 is turned on. When the ninth transistor M9 is turned on, the voltage of the initializing power source Vint is applied to the third node N3. That is, in a period where a voltage corresponding to the data signal is applied to the first node N1, the third node N3 maintains the voltage of the initializing power source Vint. Here, the voltage value of the initializing power source Vint is less than or equal to the voltage value of the first power source ELVDD.

In the first to third periods T1 to T3, the eighth transistor M8 is maintained to be turned on. Therefore, in the first to third periods T1 to T3, the voltage of the second node N2 is set to be the voltage of the first power source ELVDD.

In a fourth period T4, the emission control signal is supplied to the (n+2)th emission control line En+2 and the supply of the scan signal and the emission control signal to the nth scan line Sn and the nth emission control line En is stopped.

When the supply of the scan signal to the nth scan line Sn is stopped, the first transistor M1 and the third transistor M3 are turned off.

When the supply of the emission control signal to the nth emission control line En is stopped, the fourth transistor M4 and the fifth transistor M5 are turned on. When the fourth transistor M4 and the fifth transistor M5 are turned on, the first power source ELVDD, the fifth transistor M5, the second transistor M2, and the OLED are electrically coupled to each other. Here, the second transistor M2 supplies current corresponding to the voltage applied to the first node N1 to the OLED.

When the emission control signal is supplied (i.e., the emission control signal has high level) to the (n+2)th emission control line En+2, the seventh transistor M7 is turned on and the eighth transistor M8 is turned off. When the seventh transistor M7 is turned on, a voltage Voled applied to the OLED is supplied to the second node N2. At this time, since the voltage of the initializing power source Vint is supplied to the third node N3, the voltage of the third node N3 does not change.

In a fifth period T5, the supply of the emission control signal to the (n+1)th emission control line En+1 is stopped. When the supply of the emission control signal to the (n+1)th emission control line En+1 is stopped, the ninth transistor M9 is turned off. In this case, the third node N3 is floated.

In a sixth period T6, the supply of the emission control signal to the (n+2)th emission control line En+2 is stopped. When the supply of the emission control signal to the (n+2)th emission control line En+2 is stopped, the seventh transistor M7 is turned off and the eighth transistor M8 is turned on.

When the eighth transistor M8 is turned on, the voltage of the second node N2 is increased from the voltage Voled of the OLED to the voltage of the first power source ELVDD. At this time, since the third node N3 is floated, the voltage of the third node N3 is increased by the same amount as the increase in the voltage of the second node N2. The voltage of the floated first node N1 is also increased by (e.g., by a predetermined voltage) the same amount as the increase in the voltage of the third node N3. That is, in the sixth period T6, the voltage of the first node N1 is controlled in accordance with the amount of increase in the voltage of the second node N2. Then, the second transistor M2 supplies current corresponding to the voltage applied to the first node N1 to the OLED.

The OLED deteriorates with the lapse of time. When the OLED deteriorates, the voltage Voled applied to the OLED is increased. That is, when the same current is supplied to the OLED, the voltage Voled applied to the OLED increases as the OLED deteriorates. Therefore, as the OLED deteriorates, the amount of increase in the voltage of the second node N2 is reduced.

In more detail, as the OLED deteriorates, the voltage Voled of the OLED supplied to the second node N2 increases. When the voltage Voled applied to the OLED increases, when the voltage of the first power source ELVDD is supplied to the second node N2, the amount of increase in the voltage is reduced. When the amount of increase in the voltage of the second node N2 is reduced, the amount of increase in the voltage of the first node N1 is also reduced. Then, the amount of current supplied from the second transistor M2 to the OLED in response to the same data signal is increased. That is, according to an embodiment of the present invention, as the OLED deteriorates, the amount of current supplied from the second transistor M2 is increased so that the deterioration of brightness caused by the deterioration of the OLED can be compensated for.

In the pixels according to an exemplary embodiment of the present invention and the organic light emitting display using the same, the deterioration of the OLED is compensated for so that an image of desired brightness can be displayed. In addition, according to an exemplary embodiment of the present invention, since the gate electrode of the driving transistor is initialized using the emission control signals, a transistor is not required for initialization.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel positioned at an (i)th pixel row, the pixel comprising:

an organic light emitting diode (OLED);

a pixel circuit comprising a driving transistor for supplying a current to the OLED, a first switching transistor directly coupled to an (i)th scan line and a data line and configured to be turned on when a scan signal is supplied to the (i)th scan line to supply a data signal supplied to the data line to a first electrode of the driving transistor, the pixel circuit being configured to compensate for a threshold voltage variation of the driving transistor, the pixel circuit further comprising a storage capacitor coupled between a gate electrode of the driving transistor and an (i−1)th emission control line and configured to directly receive an emission control signal from the (i−1)th emission control line; and a compensating unit for controlling a voltage of the gate electrode of the driving transistor to compensate for deterioration of the OLED, wherein the compensating unit comprises:

a first compensating unit transistor and a second compensating unit transistor coupled between the OLED and a first power source;

a first feedback capacitor and a second feedback capacitor positioned between a second node between the first compensating unit transistor and the second compensating unit transistor and a first node between the gate electrode of the driving transistor and the storage capacitor; and a third compensating unit transistor coupled between a third node between the first feedback capacitor and the second feedback capacitor and a reference voltage source, wherein i is a natural number, and wherein a first electrode of the storage capacitor is coupled to the gate electrode of the driving transistor, and a second electrode of the storage capacitor is coupled to the (i−1)th emission control line.

2. The pixel as claimed in claim 1, wherein the pixel circuit further comprises:

a second switching transistor coupled to a second electrode of the driving transistor and the first node and turned on when the scan signal is supplied to the (i)th scan line;

a third switching transistor coupled between the first electrode of the driving transistor and the first power source and turned on when an emission control signal is not supplied to an (i)th emission control line; and a fourth switching transistor coupled between the second electrode of the driving transistor and the OLED and turned on when the emission control signal is not supplied to the (i)th emission control line.

3. The pixel as claimed in claim 1, wherein the first compensating unit transistor and the second compensating unit transistor are alternately turned on and off.

4. The pixel as claimed in claim 3, wherein an emission control signal supplied to an (i)th emission control line overlaps scan signals supplied to an (i−1)th scan line and the (i)th scan line and has a voltage of an opposite polarity to a polarity of a voltage of the scan signals.

5. The pixel as claimed in claim 3, wherein the first compensating unit transistor is turned on when an emission control signal is supplied to an (i+2)th emission control line to supply a voltage applied to the OLED to the second node, and wherein the second compensating unit transistor is turned on when the emission control signal is not supplied to the (i+2)th emission control line to supply a voltage of the first power source to the second node.

6. The pixel as claimed in claim 5, wherein the first compensating unit transistor is an NMOS transistor, and wherein the second compensating unit transistor is a PMOS transistor.

7. The pixel as claimed in claim 1, wherein the third compensating unit transistor is turned on when an emission control signal is supplied to an (i+1)th emission control line to maintain a voltage of the third node as a voltage supplied by a reference voltage source.

8. The pixel as claimed in claim 7, wherein the third compensating unit transistor is an NMOS transistor.

9. The pixel as claimed in claim 7, wherein the reference voltage source has a voltage level that is less than or equal to a voltage level of the first power source.

10. An organic light emitting display comprising:

a scan driver for supplying scan signals to scan lines and for supplying emission control signals to emission control lines;

a data driver for supplying data signals to data lines; and pixels positioned at regions defined by the scan lines and the data lines, wherein a pixel positioned at an (i)th pixel row among the pixels comprises:

an organic light emitting diode (OLED);

a pixel circuit comprising a driving transistor for supplying a current to the OLED and for compensating for a threshold voltage variation of the driving transistor, a first switching transistor directly coupled to an (i)th scan line and a data line and configured to be turned on when a scan signal is supplied to the (i)th scan line to supply a data signal supplied to the data line to a first electrode of the driving transistor, the pixel circuit further comprising a storage capacitor coupled between a gate electrode of the driving transistor and an (i−1)th emission control line and configured to directly receive an emission control signal from the (i−1)th emission control line; and a compensating unit for controlling a voltage of the gate electrode of the driving transistor to compensate for deterioration of the OLED, wherein the compensating unit comprises:

a first compensating unit transistor and a second compensating unit transistor coupled between the OLED and a first power source;

a first feedback capacitor and a second feedback capacitor positioned between a second node between the first compensating unit transistor and the second compensating unit transistor and a first node between the gate electrode of the driving transistor and the storage capacitor; and a third compensating unit transistor coupled between a third node between the first feedback capacitor and the second feedback capacitor and a reference voltage source, wherein i is a natural number, and wherein a first electrode of the storage capacitor is coupled to the gate electrode of the driving transistor, and a second electrode of the storage capacitor is coupled to the (i−1)th emission control line.

11. The organic light emitting display as claimed in claim 10, wherein the scan driver is configured to supply an emission control signal to an (i)th emission control line that overlaps scan signals supplied to an (i−1)th scan line and the (i)th scan line.

12. The organic light emitting display as claimed in claim 11, wherein a voltage of the emission control signal supplied to the (i)th emission control line is greater than or equal to a voltage supplied to the scan lines when the scan signals are not supplied.

13. The organic light emitting display as claimed in claim 10, wherein the pixel circuit further comprises:

a second switching transistor coupled to a second electrode of the driving transistor and the first node and turned on when the scan signal is supplied to the (i)th scan line;

a third switching transistor coupled between the first electrode of the driving transistor and the first power source and turned on when an emission control signal is not supplied to an (i)th emission control line; and a fourth switching transistor coupled between the second electrode of the driving transistor and the OLED and turned on when the emission control signal is not supplied to the (i)th emission control line.

14. The organic light emitting display as claimed in claim 10, wherein the first compensating unit transistor and the second compensating unit transistor are alternately turned on and off.

15. An (i)th row pixel comprising:

an organic light emitting diode (OLED);

a driving transistor for supplying a current to the OLED;

a first switching transistor directly coupled to an (i)th scan line and a data line and configured to be turned on when a scan signal is supplied to the (i)th scan line to supply a data signal supplied to the data line to a first electrode of the driving transistor, a storage capacitor coupled between a gate electrode of the driving transistor and an (i−1)th emission control line and configured to directly receive an emission control signal from the (i−1)th emission control line; and a compensating unit for controlling a voltage of the gate electrode of the driving transistor to compensate for deterioration of the OLED, wherein the compensating unit comprises:

a first compensating unit transistor and a second compensating unit transistor coupled between the OLED and a first power source;

a first feedback capacitor and a second feedback capacitor positioned between a second node between the first compensating unit transistor and the second compensating unit transistor and a first node between the gate electrode of the driving transistor and the storage capacitor; and a third compensating unit transistor coupled between a third node between the first feedback capacitor and the second feedback capacitor and a reference voltage source, and wherein a first electrode of the storage capacitor is coupled to the gate electrode of the driving transistor, and a second electrode of the storage capacitor is coupled to the (i−1)th emission control line.

16. The pixel as claimed in claim 15, further comprising:

a second switching transistor coupled to a second electrode of the driving transistor and the first node and turned on when the scan signal is supplied to the (i)th scan line;

a third switching transistor coupled between the first electrode of the driving transistor and the first power source and turned on when an emission control signal is not supplied to a second emission control line; and a fourth switching transistor coupled between the second electrode of the driving transistor and the OLED and turned on when the emission control signal is not supplied to the second emission control line.

17. The pixel as claimed in claim 16, wherein the (i−1)th emission control line is a previous emission control line, the second emission control line is a current emission control line, and the (i)th scan line is a current scan line.

18. The pixel as claimed in claim 15, wherein the first compensating unit transistor and the second compensating unit transistor are alternately turned on and off.

* * * * *

(12) SUPPLEMENTAL EXAMINATION CERTIFICATE

United States Patent (10) Number: 8,482,495 F1

Kim et al. (45) Certificate Issued: Jan. 21, 2016

Control No.: 96/000,120 Filing Date: Dec. 1, 2015

Primary Examiner: John M Hotaling II

No substantial new question of patentability is raised in the request for supplemental examination. See the Reasons for Substantial New Question of Patentability Determination in the file of this proceeding.

(56) Items of Information

FOREIGN PATENT DOCUMENTS

| | | |
|---|---|---|
| KR | 10-2007-0019463 | 02/2007 |
| KR | 10-2008-0091926 | 10/2008 |